US005921431A

United States Patent [19]

Pych

[11] Patent Number: 5,921,431

[45] Date of Patent: Jul. 13, 1999

[54] BOTTLE HOLDER

[76] Inventor: Zbigniew W. Pych, 100 Wellesley St. East Apt. 501, Toronto, Ontario, Canada, M4Y IN5

[21] Appl. No.: 08/948,041

[22] Filed: Oct. 9, 1997

Related U.S. Application Data

[63] Continuation-in-part of application No. 08/678,927, Jul. 12, 1996, abandoned.

[51] Int. Cl.[6] ..... B65D 25/22

[52] U.S. Cl. ..... 220/742; 220/903; 220/608; 215/10; 215/393

[58] Field of Search ..... 220/23.83, 23.86, 220/23.87, 23.89, 23.91, 737, 903, 740, 742, 608, 623; 215/12.1, 12.2, 11.6, 10, 392, 393, 395; 206/427, 511, 821, 564

[56] References Cited

U.S. PATENT DOCUMENTS

| | | | |
|---|---|---|---|
| 995,700 | 6/1911 | Maynard | 215/12.1 |
| 2,500,786 | 3/1950 | Austin | 215/11.6 |
| 2,722,214 | 11/1955 | Borde | 220/23.91 |
| 2,808,090 | 10/1957 | Casalino | 220/23.91 |
| 3,518,164 | 6/1970 | Andelin et al. | 220/23.89 |
| 3,942,667 | 3/1976 | Thomas | 215/12.1 |
| 4,240,560 | 12/1980 | Carluccio | 215/12.1 |
| 4,746,017 | 5/1988 | Howard et al. | 215/12.1 |
| 4,811,858 | 3/1989 | Augur | 220/903 |

*Primary Examiner*—Stephen Castellano
*Attorney, Agent, or Firm*—Ridout & Maybee

[57] ABSTRACT

A canister type holder for plastic pop-bottle includes internal ribs that coact with crenellations that are commonly present in the bottom of blow-molded bottle to inhibit the rotation of the bottle when the screw cap is removed. The holder also includes a handle to facilitate pouring of liquid from the bottle.

11 Claims, 2 Drawing Sheets

BOTTLE HOLDER

RELATED APPLICATIONS

This application is a continuation-in-part of application Ser. No. 08/678,927 filed Jul. 12, 1996, now abandoned.

FIELD OF INVENTION

This invention relates to a holder for a plastic pop bottle to facilitate the handling thereof in a domestic environment, and the combination of such bottle and holder.

BACKGROUND OF INVENTION

Plastic pop bottles, which may commonly have a capacity of two litres or thereabouts, are normally blow molded. Typically the bottle walls are relatively thin and easily deformable. Generally speaking, the bottle will be closed by a screw cap, and the deformable nature of the bottle may result in some gushing of the contents when the bottle is first opened, if the bottle is being tightly gripped to resist turning. Many persons, for example the elderly, infirm or children will be incapable of gripping the bottle so as to prevent its rotation. Gushing may also result when the relatively full bottle is tipped for pouring, as the full bottle tends to flatten when tightly gripped for pouring.

It is an object of this invention to provide a holder for plastic pop bottles to facilitate their handling.

It is a more specific object of this invention to provide a holder of this type to facilitate the screwing and unscrewing of the cap of such bottles.

It is another object of this invention to provide a holder for bottles of the foregoing type to facilitate pouring the contents thereof.

It is yet another object of this invention to provide an improved method for handling plastic pop bottles for the opening thereof and pouring of the contents therefrom.

SUMMARY OF THE INVENTION

In accordance with a broad object of this invention, there is provided in combination, a pop bottle which may typically be of a thin walled type blow molded from plastic, having a crenellated bottom, and a holder therefor comprising a tubular canister defined by a bottom wall and side walls upstanding therefrom, and wherein torque transfer means is disposed within the canister so as to engage with at least one crenellation of the bottle. As the screw cap of the bottle is rotated, the torque is transmitted through the transfer means from one or more crenellations of the bottle to inhibit the rotation of the bottle. The wall thickness of blow molded bottles at the extremities thereof is appreciably greater than in mid portions of the bottle, hence the transference of torque at the crenellations will not have the effect of flattening or otherwise unduly deforming the bottles.

Suitably, the torque transfer means will comprise at least one rib which engages a crenellation. Preferably the number of such ribs will be equal to the number of crenellations.

Preferably, the holder will include a handle, which permits the holder to be gripped so as to resist rotation when the cap is being screwed, and thereby facilitate the opening of the bottle and the pouring of its contents.

Suitably, the canister will have an open top through which the pop bottle is inserted. Preferably, the holder will include a detachable stop means to inhibit the unintended removal of the bottle from the open end. Suitably and conveniently, the detachable stop means may comprise a domed cap having a central opening therein through which the neck of the bottle will project, and may be screwably securable to the canister.

The foregoing objects and aspects of the invention, together with other objects, aspects and advantages thereof will be more apparent from a consideration of the following description of the preferred embodiment thereof taken in conjunction with the drawings annexed hereto.

DESCRIPTION OF THE PREFERRED EMBODIMENT

Figure 1:
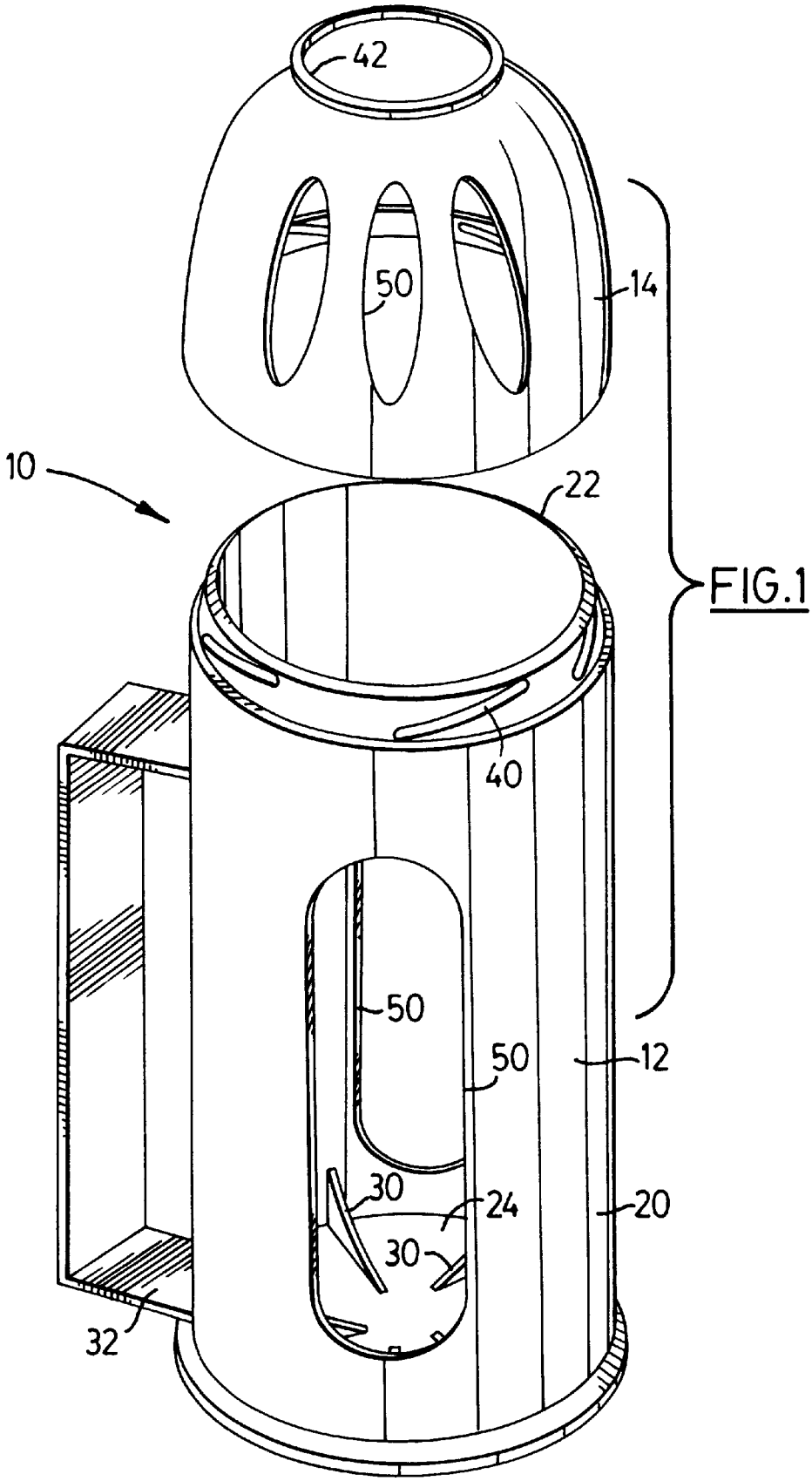
FIG. 1 shows a holder constructed in accordance with the invention in disassembled, perspective view.
Figure 2:
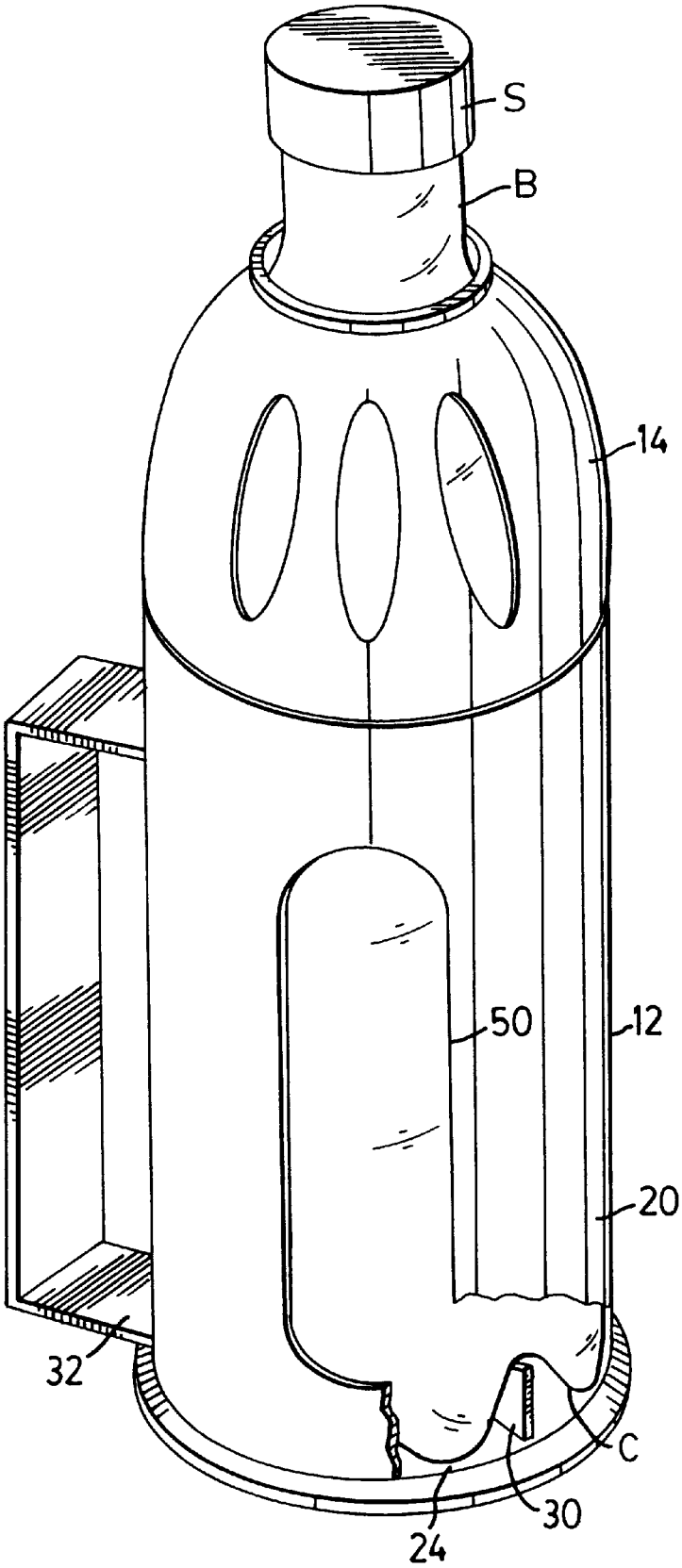
FIG. 2 shows the holder of FIG. 1 in assembled relationship with a bottle, with the holder partially broken away to reveal interior structural detail.

Referring to the drawings in detail, the holder of the invention is identified therein by the numeral 10. Holder 10 comprises a first portion namely a canister 12 and a second portion namely a detachable top 14.

Canister 12 is defined by a tubular side wall 20 which is open at the upper end 22 thereof and which is closed at the opposed end by a bottom wall 24. Five generally identical ribs 30 are disposed in equi-spaced relationship adjacent the juncture of the bottom wall 24 with the side wall 20 to extend partially over each wall, with the height of the ribs increasing an approach to the side wall. A handle 32 is secured to side wall 20 to extend substantially along the length thereof.

Detachable top 14 is in the form of a domed cap which is securable to canister 12 by means of multi-start quick threads 40. A central opening 42 is provided in top 14.

Although the dimensions of holder 10 are not critical, they will be selected to permit the entry of a selected pop-bottle B into canister 12 when top 14 is detached therefrom, and to permit the neck of the bottle to project through central opening 42 when top 14 is secured to the canister, while restraining the bottle from any undue movement relative to the holder. Generally speaking, it will be desirable that the canister portion 12 of holder 10 will extend to cover over one half of the height of the bottle, so as not to unduly restrict the length of handle 32, and thereby permit the handle to be grasped in a balancing position irrespective of the volume of the contents within bottle B located in holder 10. Elongated windows 50 are formed in both side wall 20 and top 14 through which the contents of bottle B when positioned in holder 10 may be viewable.

Bottle B has a bottom with a plurality of radial crenellations C therein, typically five, and most suitably the number of crenellations and their spacing will be equal to the number of ribs 30 and their spacing whereby each of the crenellations will be engaged by a rib 30 when the bottle is positioned in holder 10. Accordingly, when a force is applied to rotate screw cap S of the bottle, a reactive force will be transmitted to holder 10 through ribs 30 and their interaction with crenellations C, and it will be appreciated that handle 32 will facilitate the manual restraint of holder 10 and bottle B therewith. Although the interaction of ribs 30 with crenellations C generates localized pressure, it will be understood that the thickness of the bottle B in the vicinity of the crenellations is greater than in median wall portions, whereby localized deformation is limited. Moreover, the forces transmitted from screw cap S to the crenellations C are delocalized over the whole of the wall of bottle B, as a consequence of which the wall is not unduly deformed. By contrast, where bottle B is grasped manually to constrain its rotation, it will be probably grasped in medial portions thereof, precisely where it is most subject to deformation.

It will be apparent that many changes may be made to the illustrative embodiment while falling within the scope of the invention, and it is intended that all such changes be covered by the claims appended hereto.

I claim:

1. In combination a bottle and a bottle holder, wherein the combination comprises:

a bottle of a type having thin plastic walls a crenellated bottom and a screw cap;

a holder comprising a tubular canister having a central longitudinal axis, a side wall with an inner surface and a bottom wall with an inner surface;

torque transfer means disposed within said canister engaged in at least one crenellation of said pop bottle; and a portion of said torque transfer means disposed adjacent the inner surface of said bottom wall and proximal to the midpoint between the longitudinal axis of said canister and the inner surface of said side wall;

said torque transfer means serving to inhibit the rotation of said bottle when said bottle cap is rotated.

2. A combination as defined in claim 1 wherein said canister has an open top through which said pop bottle is insertable into said canister; further comprising detachable stop means serving to inhibit the withdrawal of a said bottle from said holder.

3. A combination as defined in claim 2 wherein said stop means is screwably detachable from said canister.

4. A combination as defined in claim 3 wherein said stop means is in the form of a domed cap having a central opening at the upper end thereof.

5. A combination as defined in claim 1 wherein said torque transfer means comprises a rib means disposed adjacent the juncture of said bottom wall and said side wall.

6. A combination as defined in claim 5 wherein said rib means comprises five equi-spaced radial ribs each of which extend partially along said side wall and partially along said bottom wall.

7. A combination as defined in claim 6 wherein said ribs have a progressively increasing height on approach to said sidewall.

8. A combination as claimed in claim 1, wherein at least one longitudinally elongated window opening is formed in said side wall through which said bottle is viewable when inserted into said holder.

9. A combination as defined in claim 4 wherein at least one elongated window opening is formed in said cap through which said bottle is viewable when inserted into said holder.

10. A combination as defined in claim 1 wherein said bottle is of a thin walled, blow-molded type.

11. A combination as defined in claim 7 wherein said bottle is a thin walled, blow-molded type.

* * * * *